US007351899B2

(12) United States Patent
Kennedy

(10) Patent No.: US 7,351,899 B2
(45) Date of Patent: Apr. 1, 2008

(54) QUICK ACTION DRUM LUG ASSEMBLY AND METHOD

(75) Inventor: Christopher J. Kennedy, Apex, NC (US)

(73) Assignee: Think Peak, Inc., Apex, NC (US)

( * ) Notice: Subject to any disclaimer, the term of this patent is extended or adjusted under 35 U.S.C. 154(b) by 235 days.

(21) Appl. No.: 11/080,018

(22) Filed: Mar. 15, 2005

(65) Prior Publication Data

US 2006/0207406 A1 Sep. 21, 2006

(51) Int. Cl.
*G10D 13/02* (2006.01)

(52) U.S. Cl. ..... 84/411 R; 84/413

(58) Field of Classification Search ..... 84/411 R, 84/413; 403/61, 360, 361, 384
See application file for complete search history.

(56) References Cited

U.S. PATENT DOCUMENTS

| | | | | | |
|---|---|---|---|---|---|
| 42,320 | A | * | 4/1864 | Thomas | 470/87 |
| 674,550 | A | * | 5/1901 | Zeidler | 84/411 R |
| 1,039,834 | A | * | 10/1912 | Soistmann | 84/411 R |
| 1,867,229 | A | * | 7/1932 | Nelson | 470/24 |
| 2,120,061 | A | * | 6/1938 | Blakeslee | 200/507 |
| 2,189,682 | A | * | 2/1940 | Schmutz | 101/415.1 |
| 2,331,322 | A | * | 10/1943 | Heinick | 411/103 |
| 3,193,871 | A | * | 7/1965 | Foltz | 210/98 |
| 3,219,790 | A | * | 11/1965 | Johnson | 219/93 |
| 3,439,152 | A | * | 4/1969 | Kloska | 219/536 |
| 3,456,549 | A | * | 7/1969 | Horton | 411/427 |
| 3,456,706 | A | * | 7/1969 | Ollis, Jr. | 411/84 |
| 3,533,324 | A | | 10/1970 | Price | |
| 3,539,234 | A | * | 11/1970 | Rapata | 384/203 |
| 3,770,261 | A | * | 11/1973 | Anderson | 269/47 |
| D229,610 | S | * | 12/1973 | Shinjo | D8/397 |
| 3,792,879 | A | * | 2/1974 | Dunmire et al. | 285/197 |
| 4,122,747 | A | * | 10/1978 | Yamashita | 84/411 R |
| 4,183,387 | A | * | 1/1980 | Lenz | 411/116 |
| 4,188,852 | A | * | 2/1980 | Light | 84/411 A |
| 4,206,681 | A | | 6/1980 | Kluczynski | |
| 4,373,419 | A | * | 2/1983 | Tuttrup | 84/411 R |
| 4,475,434 | A | | 10/1984 | Willis | |
| 4,506,586 | A | * | 3/1985 | Brewer | 84/413 |
| 4,530,493 | A | * | 7/1985 | Break | 269/93 |
| 4,583,442 | A | | 4/1986 | Minor | |
| 4,630,521 | A | | 12/1986 | Alletto | |
| 4,637,641 | A | * | 1/1987 | Kennedy, Jr. | 285/337 |
| 4,693,163 | A | * | 9/1987 | Hsieh | 84/413 |
| 4,694,726 | A | | 9/1987 | Silvestri | |

(Continued)

*Primary Examiner*—Lincoln Donovan
*Assistant Examiner*—Robert W Horn
(74) *Attorney, Agent, or Firm*—Coats & Bennett, P.L.L.C.

(57) ABSTRACT

Lug assemblies and associated methods of attaching a drum head to a drum body. The lug assembly may comprise a lug body having a seating surface; an elongate link having a proximate end disposed proximate the drum head and a distal end disposed distal from the drum head; a stop assembly adjustably coupled to the link. The stop assembly constrains the link distal end from movement toward the drum head when the stop assembly engages the link and bears against the seating surface. Engagement surfaces constrain rotation of the stop assembly and thereby allow the stop assembly to be moved toward the link distal end when the link proximate end is closer to the stop assembly than the seating surface. The stop assembly may be inserted into the recess from a direction that is generally tangential to a periphery of the drum body.

12 Claims, 3 Drawing Sheets

U.S. PATENT DOCUMENTS 4,742,752 A 5/1988 Lubbers
4,750,401 A 6/1988 Hoshino
4,790,299 A 12/1988 Hoshino
4,830,531 A * 5/1989 Condit et al. ..... 403/348
4,903,569 A 2/1990 Kurosaki
4,957,402 A * 9/1990 Klein et al. ..... 411/84
4,980,805 A * 12/1990 Maglica et al. ..... 362/191
5,071,279 A * 12/1991 Rutstrom ..... 403/90
5,071,309 A * 12/1991 Herbermann ..... 414/680
D322,929 S * 1/1992 Abbestam et al. ..... D8/397
5,104,270 A * 4/1992 Ritzl ..... 411/85
D332,568 S * 1/1993 Ozawa ..... D8/397
5,244,193 A * 9/1993 Hehr ..... 269/99
5,383,738 A * 1/1995 Herbermann ..... 403/56
5,509,644 A * 4/1996 Engibarov ..... 269/99
D385,777 S * 11/1997 Vallery ..... D8/397
5,690,416 A * 11/1997 Van Gennep ..... 362/191
5,735,512 A * 4/1998 Waddell ..... 269/21
6,078,003 A * 6/2000 DeVito ..... 84/411 R
6,338,589 B1 * 1/2002 Kincaid et al. ..... 403/130
6,365,811 B1 4/2002 Conta
6,459,026 B1 10/2002 Bozzio
6,492,583 B1 12/2002 Wilkey
6,581,977 B1 * 6/2003 Dole et al. ..... 285/112
6,700,045 B2 * 3/2004 Del Valhe ..... 84/413
6,747,199 B2 * 6/2004 Shah ..... 84/411 R
6,828,495 B2 * 12/2004 Ishimatsu ..... 84/413
D521,858 S * 5/2006 Roy ..... D8/397
2002/0046637 A1 * 4/2002 Meinl ..... 84/411 R
2002/0194978 A1 12/2002 Hagiwara
2004/0065185 A1 * 4/2004 Hagiwara ..... 84/413
2005/0188817 A1 * 9/2005 Whittington ..... 84/413
2006/0207406 A1 * 9/2006 Kennedy ..... 84/411 R

* cited by examiner

QUICK ACTION DRUM LUG ASSEMBLY AND METHOD

BACKGROUND OF THE INVENTION

The present invention is directed generally to the field of musical drums, and more particularly, a quick-action drum lug assembly and methods of using the same to attach a drum head to a drum body.

A conventional musical drum is typically formed by a cylindrical drum body having one end, and sometime both ends, covered by a drum head. The drum head typically includes a rim which holds a drum skin in tension over the drum body. The rim is secured to the drum body by a plurality of tension screws which pass through the rim and are received in brackets mounted around the periphery of the drum body. When it becomes necessary to remove the drum head, for maintenance or to simply install a different drum head, the tension screws must be unscrewed from their corresponding brackets, the old drum head removed, the new/repaired drum head placed over the drum body, and the tension screws retightened. This is a time consuming and cumbersome task.

A number of devices have been proposed in the prior art to facilitate the installation of new or replacement drum heads. For example, U.S. Pat. No. 4,506,586 to Brewer discloses a quick-release drum head restraint device that utilizes a pivoting lug, referred to as a "toggle unit," that helps anchor the tension screws. A spring-based approach is shown in U.S. Pat. No. 4,122,747 to Yamashita, with a different spring and lever approach shown in U.S. Pat. No. 3,533,324 to Price. Still other designs of drum head systems are shown in U.S. Patent Application Publication 2004/0065185, including an approach that uses downwardly pointing hooks (see FIG. 9 of the publication). Of course, numerous other drum head tensioning devices have also been proposed, but none have proven entirely satisfactory.

Thus, there remains a need for alternative approaches to providing tension to drum heads.

BRIEF SUMMARY OF THE INVENTION

In one embodiment, the present invention provides a lug assembly for releasably securing a drum head to a drum body of a musical drum. The lug assembly may comprise a lug body having a seating surface; an elongate link having a proximate end disposed proximate the drum head and a distal end disposed distal from the drum head; a stop assembly adjustably coupled to the link; wherein the stop assembly constrains the link distal end from movement toward the drum head when the stop assembly engages the link and bears against the seating surface; the lug body having engagement surfaces that constrain rotation of the stop assembly and thereby allow the stop assembly to be moved toward the link distal end when the link proximate end is closer to the stop assembly than the seating surface. The stop assembly may comprise a nut or a nut and a spacer. The link may comprise a substantially straight rod, or some other shape/style of link. The lug body may further comprise a pair of spaced flanges, with the engagement surfaces forming interior surfaces of the flanges. The lug body may further comprise a recess for accommodating the stop assembly. The stop assembly may comprise tightening surfaces separated by a first distance, and the lug body further comprise: a first opening extending from the recess proximate the seating surface and having a first width smaller than the first distance; the link to passing through the first opening; a second opening extending from the recess in a direction generally perpendicular to the first opening and having a second width larger than both the first width and the first distance.

In another embodiment, the present invention provides a musical drum assembly comprising: a drum body; a drum head; and a plurality of lug assemblies releasably securing the drum head to the drum body. Each of the lug assemblies comprises: a lug body having a seating surface; an elongate link having a proximate end disposed proximate the drum head and a distal end disposed distal from the drum head; a stop assembly adjustably coupled to the link; wherein the stop assembly constrains movement of the link distal end toward the drum head when the stop assembly engages the link and the seating surface; the lug body having engagement surfaces that constrain rotation of the stop assembly and thereby allow the stop assembly to be moved toward the link distal end when the link proximate end is closer to the stop assembly than the seating surface. The plurality of lug bodies may be mounted on the drum body. Each lug body may further comprise a recess for accommodating the corresponding stop assembly. Each stop assembly may comprise tightening surfaces separated by a first distance, with each of the lug bodies further comprising: a first opening extending from the recess proximate the seating surface and having a first width smaller than the first distance; the link to passing through the first opening; a second opening extending from the recess in a direction generally perpendicular to the first opening and having a second width larger than both the first width and the first distance.

In another embodiment, the present invention provides a musical drum lug for engaging a stop assembly associated with a tension link, the stop assembly having tightening surfaces separated by a first distance. The drum lug comprises: a lug body having a top facing a first direction and a side facing a second direction different from the first direction; a recess in the lug body bounded by a seating surface toward the top for accommodating the stop assembly; a first opening in the top extending from the recess and having a first width smaller than the first distance; a second opening in the side extending from the recess and having a second width larger than both the first width and the first distance; the lug body having a plurality of engagement surfaces proximate second opening disposed to constrain rotation of the stop assembly when the engagement surfaces engage the stop assembly and the lug top is closer to the stop assembly than the seating surface. The engagement surfaces may be spaced apart by an amount approximately equal to the second width. The lug body may further comprise a pair of spaced flanges, with the engagement surfaces forming interior surfaces of the flanges. The lug body may further comprise at least one threaded mounting hole. The seating surface may have a profile of a portion of a sphere.

In a method embodiment, the present invention provides a method of securing a drum head to a drum body via a plurality of drum lug assemblies, each drum lug assembly comprising a lug body disposed on the drum body and having a bearing surface, a link having a first end proximate the drum head and a second end distal from the drum head the drum body, and a stop assembly adjustably coupled to the link, the method comprising: for at least one of the drum lug assemblies, engaging the stop assembly with the lug body; and, during the engagement moving the stop assembly from a first position along the corresponding link to a second position, the first position located closer to the first end of the corresponding link than the bearing surface; thereafter, applying tension to the link of the lug assembly by moving the stop assembly along the link to a third position bearing against the bearing surface, the lug body constraining the stop assembly to remain at least as far from the drum head as the bearing surface during the tension application. The method may further comprise repeating the engaging and the tension applying for at least another one of the drum lug assemblies. The lug body may comprise a recess and the bearing surface forms a boundary of the recess, and the step of applying tension to the link may comprise applying tension to link with the stop assembly disposed at least partially within the recess. The method may comprise moving the stop assembly along the link to a third position by rotating the stop assembly relative to the link. The method may comprise moving the stop assembly from the first position to the second position by rotating the link relative to the lug body while the lug body prevents rotation of the stop assembly relative to the lug body.

In another embodiment, the present invention provides a lug assembly for releasably securing a drum head to a drum body of a musical drum, the drum body having a curved outer perimeter, the lug assembly comprising: an elongate link having a longitudinal axis; a lug body having a recess bounded by first and second opposing interior sidewalls; a first opening in the lug body extending from the recess in a first direction generally parallel to the longitudinal axis and having a first width; the link extending through the first opening; a second opening in the lug body extending from the recess in a second direction generally perpendicular to the longitudinal axis and generally tangential to the perimeter, the second opening having a second width between the first and second sidewalls; a stopper adjustably coupled to the link and having tightening surfaces separated by a first distance that engage the first and second sidewalls, the stopper disposable at least partially in the recess so as to engage the link to constrain movement thereof in a direction toward the drum head; wherein the stopper inserts into the recess via the second opening; wherein the first distance is larger than the first width and smaller than the second width. The stopper may comprise a spacer disposed on the link more proximate the drum body than a nut. The link may comprise a drive end, and a tightening torque applied to the drive end may cause the link to rotate relative to the lug body and the stopper so as to shorten a distance between the drive end and the stopper. The lug body may be mounted on the drum body. The lug assembly may further comprise a seating surface for being borne against by the stopper, the seating surface disposed proximate the first opening and partially defining the recess.

In another embodiment, the present invention provides a musical drum lug for engaging a stopper coupled to a link, the stopper having tightening surfaces separated by a first distance, comprising: a lug body having a top and a side; a recess in the lug body bounded by a seating surface toward the top for accommodating the stopper and first and second interior sidewalls; a first opening in the top for allowing the link to pass therethrough, the first opening extending from the recess proximate the seating surface and having a first width smaller than the first distance; a second opening in the side extending from the recess and having a second width between the first and second walls larger than both the first width and the first distance. The lug body may further comprise at least one threaded hole for accepting a fastener for mating the lug body to a drum shell of a musical drum, wherein the lug body further comprises a contoured back surface proximate the threaded hole.

In another embodiment, the present invention provides a method of securing a drum head to a drum body via a plurality of drum lug assemblies, each drum lug assembly comprising a side-entry lug body disposed on the drum body, a link, and a stop assembly adjustably coupled to the link, the method comprising: for at least one of the drum lug assemblies, inserting the stop assembly at least partly into a recess on the lug body from a direction that is generally tangential to a periphery of the drum body; engaging the stop assembly with opposing engagement surfaces so as to limit rotation of the stop assembly relative to the lug body; during the engaging, applying tension to the link of the lug assembly by causing the stop assembly to bear against a bearing surface of the lug body, the bearing surface disposed along a longitudinal axis of the link closer to the drum head than a portion of the engagement surfaces engaging the stop assembly when the tension is applied. This method may further comprise repeating the inserting, the engaging, and the tension applying for at least another one of the drum lug assemblies. The method may be such that the bearing surface constrains the stop assembly to remain at least as far from the drum head as the bearing surface during the tension application. The applying tension to the link may comprise rotating the link relative to the stop assembly while the stop assembly remains substantially unrotated relative to the lug body.

Further, one or more of the above optional aspects may be combined in various different embodiments.

DETAILED DESCRIPTION OF THE INVENTION

The overall intent of the present invention is to provide an alternative means for securing a drum head to a drum body in a musical drum. To that end, the present invention provides a novel quick action lug assembly that helps secure the drum head in place and/or a method of attaching the drum head to the drum body that may use the new lug assembly.

Figure 1:
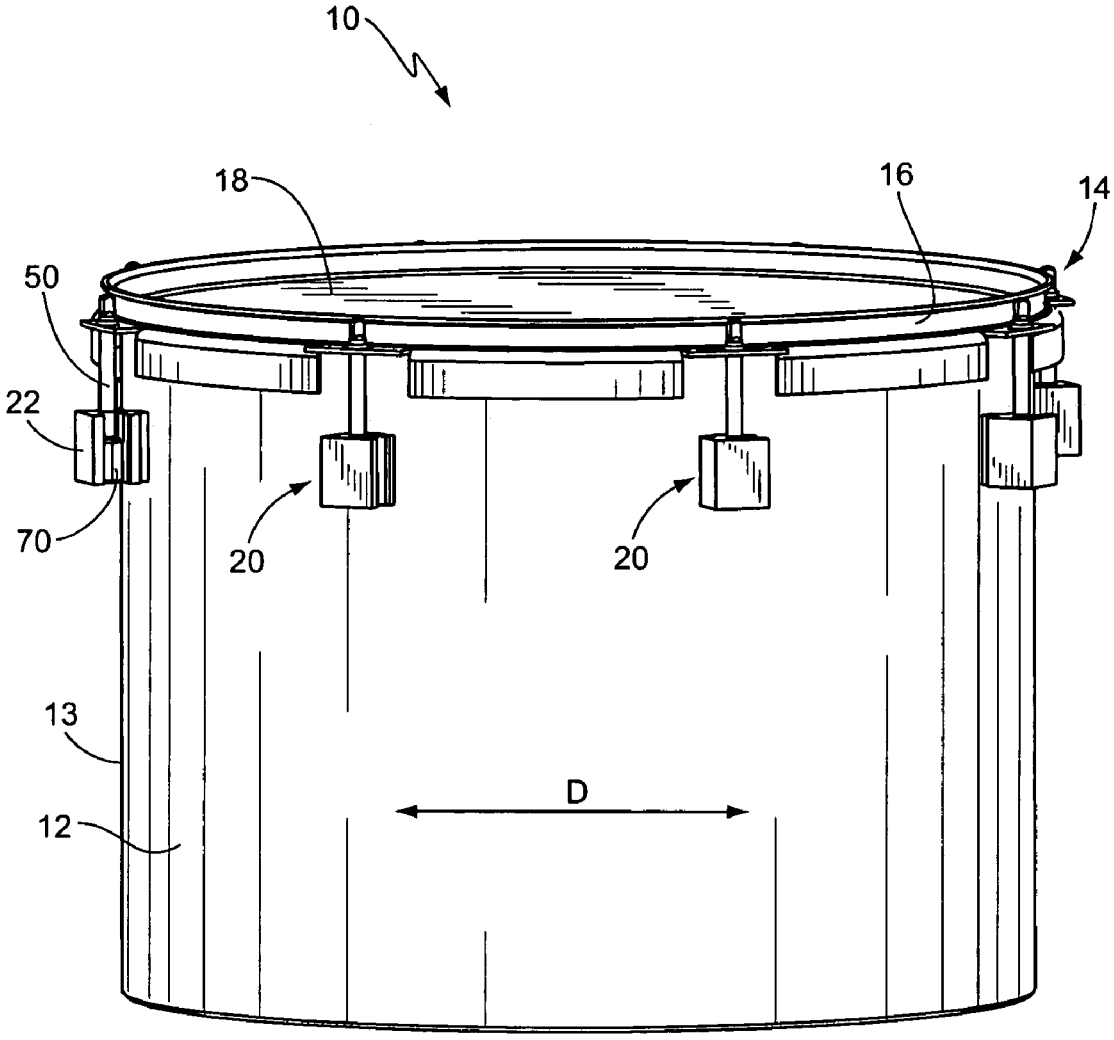
FIG. 1 shows a drum assembled in accordance with one or more embodiments of the present invention.
Figure 2:
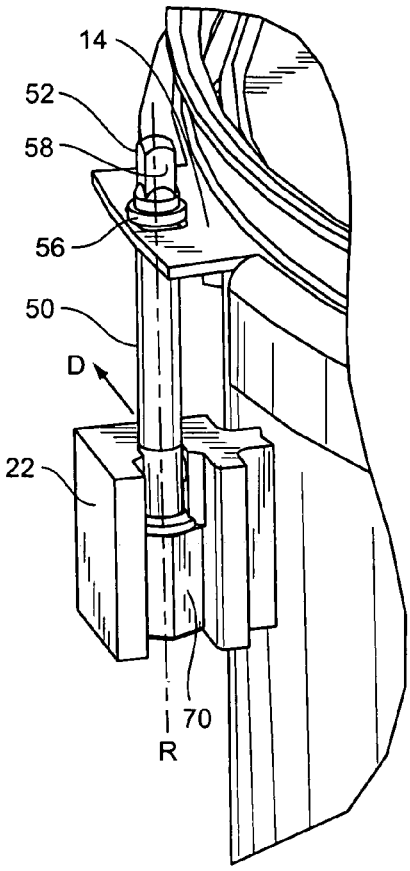
FIG. 2 shows a more detailed view of a drum lug assembly of FIG. 1.
Figure 3:
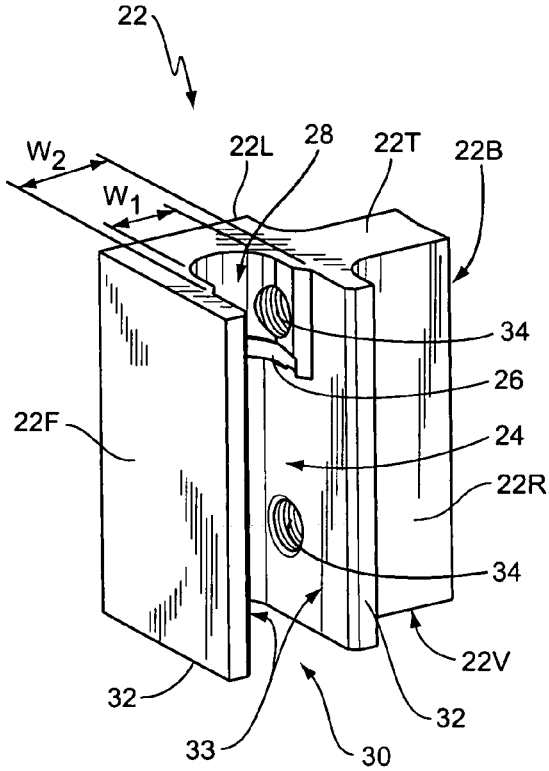
FIG. 3 shows one embodiment of a lug body.
Figure 4:
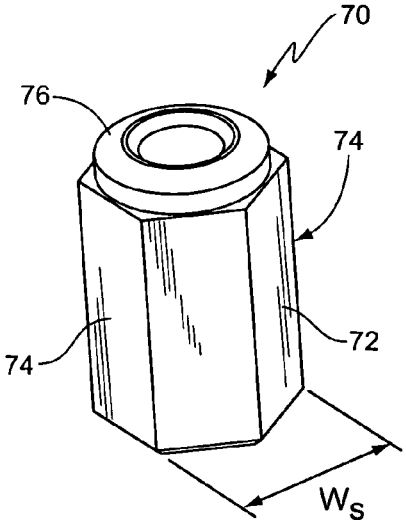
FIG. 4 shows one embodiment of a stop assembly.
Figure 5:
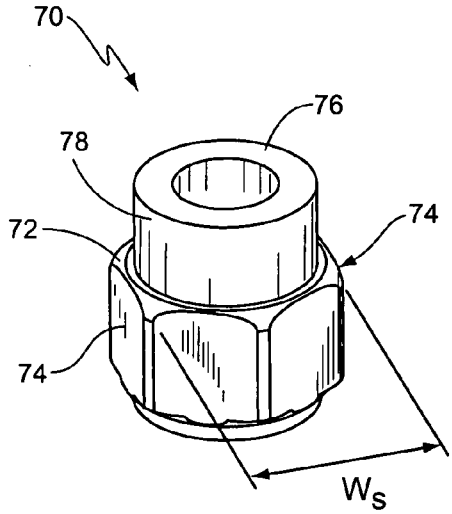
FIG. 5 shows another embodiment of a stop assembly.
Figure 6:
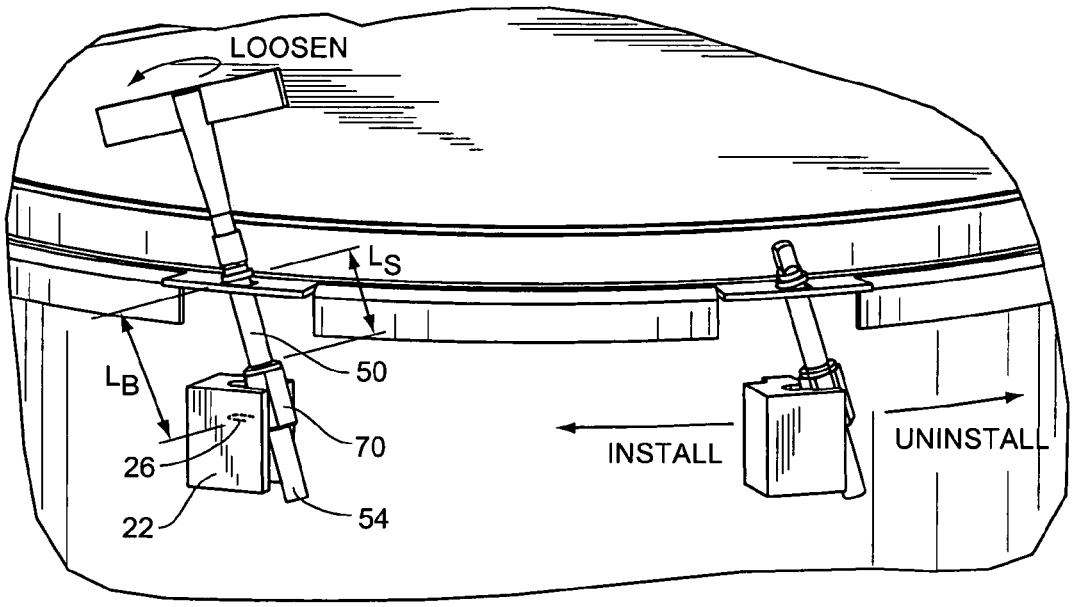
FIG. 6 shows one embodiment of the drum lug assembly during the process of installing a drum head in one embodiment of the invention.

As illustrated in FIG. 1, a drum 10 that may take advantage of the present invention includes a drum body 12 or shell having at least one end covered by a drum head 14. The drum body 12 is typically a cylindrical section of material, such as wood, that has a curved outer perimeter 13. The drum head 14 includes a rim 16 which holds a drum skin 18 in tension over the drum body 12. The rim 16 is secured to the drum body 12 by a plurality drum lug assemblies 20 disposed about the periphery of the drum body 12. For additional information regarding the general construction of musical drums, attention is directed to U.S. Pat. Nos. 3,533,324; 4,122,747; and 4,630,521, and U.S. Patent Application Publication 2004/0065185, all of which are incorporated herein by reference.

The lug assemblies 20 of the present invention each include a lug body 22, a link 50, and a stop assembly 70. The lug body 22 is mounted to the outer periphery 13 of the drum body 12 and allows the link 50 to be releaseably anchored to the drum body 12. For ease of reference, the lug body 22 is considered to have a back 22B, a front 22F, a top 22T, a bottom 22V, a left side 22L, and a right side 22R. The lug body 22 attaches to the drum body 12 along the back 22B, with the front 22F facing generally radially outward from the drum body 12. Thus, the left side 22L and right side 22R of the lug body 22 are oriented in directions that are generally tangential to the periphery 13 of the drum body 12, such as direction D. The lug body 22 includes a recess 24 formed therein. The recess 24 is bounded on its top end by a shoulder forming a seating surface 26, sometimes referred to herein as the bearing surface. This seating surface 26 advantageously has a profile of a portion of a sphere, for reasons explained further below. The recess 24 connects to a top passage 28 that opens to the top 22T of the lug body 22. Thus, the top passage 28 extends through the conceptual plane of the seating surface 26. The width of the top passage 28 at this point is $W_1$. As explained further below, it is intended that the link 50 extend from the recess 24 to the drum head 14 through the top passage 28 when the drum lug assembly 20 is in its in-use fully tensioned configuration and when the lug assembly 20 is being tightened. The recess 24 further connects to a side passage 30 that opens to one or both of the left and right sides 22L,22R of the lug body 22. For purposes of illustration, the lug body 22 is shown in the Figures as having the side passage 30 opening to the right side 22R of the lug body 22. The side passage 30 is bounded by flanges 32 that advantageously extend in direction D generally tangent to the periphery of the drum body 12. These flanges 32 are spaced from one another so that the side passage 30 has a width of $W_2$ and may have an inwardly chamfered or otherwise tapered distal portions. The inside surfaces of the flanges 34 form engagement surfaces 33 for engaging the stop assembly 70 as described further below. The bottom of the recess 24 is typically open, with the front and rear of the recess 24 typically being fully closed, although such is not required in all embodiments. The recess 24 is intended to accept the stop assembly 70 via the side passage 30, with the link 50 extending out the lug body 22 through the top passage 28. Thus, in this embodiment, the lug body 22 may be considered a side-entry lug body 22.

The lug body 22 is securely mounted to the outer periphery of the drum body 12. To this end, the lug body 22 may include one, two, or more two mounting holes 34 that extend through the lug body 22, but typically not through the recess 24. Appropriate mounting screws (not shown) extend through these mounting holes 34 to secure the lug body 22 to the drum body 12. Such mounting screws may, if desired, have unthreaded shoulders that extend through holes in the drum body 12, with heads disposed on the inside of the drum body 12 and threaded portions that terminate in the threaded mounting holes 34. It should be noted that the back 22B of the lug body 22 may advantageously have a V-shape, or other indented shape, to help minimize contact between the lug body 22 and the drum body 12. Of course, other techniques may be used to attach the lug body 22 to the drum body 12, advantageously, but not necessarily, in a removable fashion. For example, adhesives may alternatively be used, or the lug body 22 may be integrally formed with the drum body 12.

The link 50 helps apply a tension force to the rim 16 of the drum head 14 and typically takes the form of a cylindrical rod; therefore, the link 50 is sometimes referred to as link rod 50 or a tension rod 50. The link rod 50 is generally elongate along longitudinal force axis R, and has an upper end 52 and a lower end 54. The upper end 52 is located proximate the drum head 14, and typically includes both an expanded section 56 and a faceted section 58. The expanded section 56 helps prevent the link rod 50 from disengaging from the rim 16 when under tension, while the faceted section 58 provides a means for applying tightening or loosening torque. The lower end 54 of the link rod 50 includes a threaded section of suitable length, advantageously extending to the very end of the link rod 50, for coupling to a stop assembly 70 to the link rod 50. It should be noted that when assembled, the link rods 50 are coupled to the rim 16 of the drum head 14. In some embodiments, it may be advantageous to have the link rod 50 relatively permanently mated to the rim 16, while in other embodiments, the link rod 50 may be readily removable therefrom when not in use. For example, the link rods 50 may be joined to the rim 16 by inserting the lower portion 54 of the link rods 50 through suitable holes in the outer portion of the rim 16 and attaching the stop assemblies 70 to their corresponding link rods 50, if not already present.

The stop assembly 70, or simply stopper, may take any one of a variety of forms, but advantageously takes the form of a hex nut 72 having a hemi-spherical top. The stop assembly 70 includes at least two tightening surfaces 74, typically at circumferentially opposing positions, spaced apart by distance $W_S$. The stop assembly 70 is threaded on the link rod 50 so as to be moveable along the link rod 50 toward or away from the upper end 52 of the link rod 50 along the link rod 50. It is intended that the stop assembly 70 will be located at least partially in the recess 24, and apply pressure against the lug body's seating surface 26, when the lug assembly 20 is fully tightened. The top of the nut 72 may advantageously have a hemispherical shape forming a seating surface 76 that corresponds to the shape of the lug body's seating surface 26. Such a configuration is believed to allow the stop assembly 70 to be somewhat self-centering with respect to the lug body's seating surface 26 from a variety of initial orientations. In other embodiments, the seating surface 76 of the stop assembly 70 may be provided by a spacer 78 disposed between a nut 72 and the lug body's seating surface 26. This spacer 78 may advantageously include a hemi-spherical shaped top as discussed above. With either embodiment, the stop assembly 70 bears against the lug body's seating surface 26 when the working tension is applied to the link 50. For purposes herein, the stop assembly 70 may be considered as bearing against the lug body's seating surface 26 even if there is an intervening member, such as a cushion, disposed therebetween. On the other hand, the stop assembly 70 may be considered as bearing directly against the lug body's seating surface 26 if there is not any intervening member disposed between the stop assembly 70 and the lug body's seating surface 26. Further, the position of the stop assembly 70 along the link 50 is considered, for purposes herein, as being the position along the link 50 of that portion of the stop assembly 70 that bears against the lug body's seating surface 26.

The lug assemblies 20 of the present invention facilitate installation and/or replacement of a drum head 14. In one embodiment, a plurality of lug bodies 22 are attached to various locations on the drum body 12, advantageously at some uniform spacing around the periphery of the drum body 12 at a predetermined distance down from the top of the drum body 12. As indicated above, the lug bodies 22 are attached to the drum body 12 with the rear portions 22B thereof facing the drum body 12. The drum skin 18 is attached to the rim 16 in any conventional fashion and the link rods 50 are coupled to the rim 16 as described above.

The drum head 14 is then loosely positioned over the drum body 12, with the link rods 50 extending down toward the lug bodies 22. Advantageously, each of the link rods 50 is arranged so that the associated stop assemblies 70 are located all on one side proximate their corresponding lug body 22 (i.e., all just clockwise from, or all just counter-clockwise from, when viewed from above). The rim 16 of drum head 14 is then rotated with respect to drum body 12 to bring the stop assemblies 70 into engagement with the corresponding flanges 32 on the sides of the side-entry lug bodies 22 leading to the recesses 24 thereof. In this fashion, the engagement surfaces 33 of the lug body 22 (e.g., the inside surfaces of the flanges 32) engage the tightening surfaces 74 of the stop assemblies 70. Alternatively, the user may individually manipulate one or more stop assemblies 70 to bring the tightening surfaces 74 of the stop assembly 70 (e.g., the sides of the nut 72), into engagement with the corresponding engagement surfaces 33 of the corresponding lug body 22.

It should be noted that at this point of the process, the stop assemblies 70 may be located along the link rod 50 relative to the top end 52 of the link rod 50, and hence the rim 16, a distance $L_S$ that is more than, less than, or the same as the distance $L_B$ from the top end 52 of the link rod 50 to the corresponding bearing surface 26 on the lug body 22. If distance $L_S$, prior to tightening, is the same as or smaller than distance $L_B$, the stop assembly 70 is moved farther away from the top end 52 of the link rod 50, optionally as described further below, so as to allow the stop assembly 70 to be properly positioned in recess 24. If, on the other hand, distance $L_S$ is greater than $L_B$ by some moderate amount, then the desired tension may be applied to the link rod 50 by simply rotating the link rod 50 the appropriate direction to cause the stop assembly 70 to move toward the top end 52 of the link rod 50. During this rotation, the link rod 50 rotates relative to the stop assembly 70, as the stop assembly 70 is restrained against rotation by the engagement of tightening surfaces 74 with the lug body 22. The travel of the stop assembly 70 toward the top end 52 of the link rod 50 is halted as the stop assembly 70 engages against bearing surface 26. Thus, in this embodiment, the tightening of the link 50 assembly may be accomplished by one hand, as the lug body 22 prevents rotation of the stop assembly 70 when the two are mutually engaged. When tightened sufficiently, the stop assembly 70 bears against the seating surface 26 of the lug body 22 and is disposed at least partially, and advantageously entirely, within the recess 24. The other drum lug assemblies 20 are then tightened to the desired tension to secure the drum head 14 to the drum body 12. Tuning of the drum head 14, if necessary or desired, is then accomplished in a conventional fashion by further tightening/loosening of the various drum lug assemblies 20.

When it is desired to remove the drum head 14, the drum lug assemblies 20 are loosened, such as by rotating the link rods 50 in the appropriate "loosening" direction. As a result of this rotation, the stop assembly 70 moves along the link rod 50 in a direction away from the drum head 14. When the various drum lug assemblies 20 are loosened sufficiently, the rim 16 is rotated to bring the stop assemblies 70 out of engagement with their corresponding lug bodies 22. If replacing the drum skin 18, the old drum skin 18 is removed from the rim 16 and a new one added. The drum head 14 is then joined to the drum body 12 as described above.

It should be noted that drum skins 18 tend to expand somewhat in use, typically requiring the drum lug assemblies 20 to be tightened over time to "tune" the drum 10. Thus, it is common for the old drum skin 18 to require that the drum lug assemblies 20 be "tighter" than a new drum skin 18. Thus, it is common for drum lug assemblies 20 to require more loosening to install a new drum skin 18 than is required to remove the old drum skin 18. Most embodiments of the present drum lug assemblies 20 provide an improved means for dealing with this situation. In particular, the drum lug assemblies 20 of most embodiments of the present invention allow the drum lug body 22 to engage the stop assemblies 70 to resist rotation thereof (relative to the lug body 22) even when the stop assemblies 70 are in a position that would be too close to the drum head 14 to allow the stop assembly 70 to be brought into engagement with its corresponding bearing surface 26. Stated another way, and with respect to the typical orientation of the drum lug assembly 20, these embodiments allow the stop assembly 70 to be engaged by the lug body 22 so as to allow the drum lug assembly 20 to be "loosened" even when the stop assembly 70 is "above" the bearing surface 26. This action is provided by the configuration of the drum lug body 22 that allows the engagement surfaces 33 thereof to engage the tightening surfaces 74 of the stop assembly 70 (e.g., opposing facets of the nut 72) even if $L_S$ is smaller than $L_B$ (meaning that the top of the stop assembly 70 is closer to the drum head 14 than the distance $L_B$ between the lug body's bearing surface 26 and the drum head 14). Thus, the user need not grip the stop assembly 70 by hand in order to loosen it, because the stop assembly 70 is engaged by the lug body 22, thereby freeing the user's hand for other tasks.

Further, as can be appreciated, some embodiments of the present invention allow the stop assemblies 70 to enter their corresponding drum lug bodies 22 in a generally tangential direction D, rather than a radial direction. As such, a simple rotation of the rim 16 of drum head 14 may be used to bring all the stop assemblies 70 and the link rods 50 into/out of engagement with their drum lug bodies 22 in most instances. Thus, with preferred embodiments of the present invention, the user need not individually couple each stop assembly 70 to its corresponding drum lug body 22, thereby lessening the time required to change drum heads 14.

The components of the drum lug assembly 20 may be formed of any suitable material, such as aluminum (cast and/or machined), stainless steel (cast and/or machined), plastic, and/or various suitable composites.

In some embodiments, the drum lug bodies 22 may also include suitable structures to allow the drum lug bodies 22 to be used to suspension mount the assembled drum 10. For example, one or more drum lug bodies 22 on a given drum 10 may optionally include one or more threaded holes (not shown) on the front 22F that can be used to attach any one of a variety of drum suspension devices known in the art.

The drum lug body 22 shown in the Figures is but one of numerous possible configurations. Thus, it should be understood that the drum lug bodies 22, and indeed the link rods 50, etc., may take on any desired ornamental appearance without departing from the scope of the present invention. Just by way of example, the front 22F of the drum lug body 22 may have the appearance of a lightening bolt, a keystone, a coffin, or any other appropriate shape.

The discussion above has generally been in terms of the drum lug assemblies 20 helping to pull the drum head 14 downwardly. However, it should be noted that the drum lug assemblies 20 may, in some embodiments, also be used to secure a lower drum head 14 to a drum body 12 by pulling the drum head 14 upward against the drum body 12. Thus, the drum lug assemblies 20 of the present invention may be used to secure a "top" drum head 14 and/or a "bottom" drum head 14. Indeed, in some embodiments, a single drum lug body 22 may be coupled to multiple link rods 50, such as one extending upward and one extending downward. Further, multiple drum lug bodies 22 may be joined together and jointly mounted to the drum body 12, if desired.

The discussion above has generally been in terms of the side-entry drum lug bodies 22 having side passages 30 to their recess 24 that open to the right (when viewed from above); however, as pointed out above, the drum lug bodies 22 may have side passages 30 to their recess 24 that open to the left. Indeed, in for some drums 10, it may be advantageous to have a mixture of left and right opening drum lug bodies 22. For an example of this latter situation, it may be advantageous on a horizontally oriented bass drum to have right opening drum lug bodies 22 on one side of the drum body 12 and left opening drum lug bodies 22 on the other, so that the bass drum head 14 can be changed with the drum 10 sitting in the typical playing orientation, but with the link rods 50 and stop assemblies 70 "falling" into the corresponding drum lug bodies 22 by gravity.

The discussion above has generally been in terms of the lug bodies 22 being directly mounted to the drum body 12. However, the lug bodies 22 may alternatively be secured to a fixture external to the drum body. For example, the lug bodies 22 securing the upper drum head 14 may be directly mounted to an external ring. The ring may, in turn, be secured to a bottom drum head 14 by fixed standoffs. In such an arrangement, tightening of the drum lug assemblies 20 may result in changing the tension on both the top drum skin 18 and the bottom drum skin 18. Alternatively, the drum lug bodies 22 may be "floating" relative to the drum body 12, but supported by an opposing drum head 14. For example, the bottom drum head 14 (or just a rim 16) may have a plurality of lug bodies 22 secured thereto by corresponding fixed standoffs, and the top drum head 14 secured to the drum body 12 by drum lug assemblies using those lug bodies 22. In other embodiments, the lug bodies 22 may be directly mounted on the lower drum head 14 (or just a rim 16).

In preferred embodiments, all the drum lug assemblies 22 associated with a given drum 10 are of one of the new design variously described herein. However, it is within the scope of at least some embodiments of the present invention for a drum 10 to have a mixture of old style drum lug assemblies and the new drum lug assemblies 20 described herein.

The present invention may, of course, be carried out in other specific ways than those herein set forth without departing from the essential characteristics of the invention. The present embodiments are, therefore, to be considered in all respects as illustrative and not restrictive, and all changes coming within the meaning and equivalency range of the appended claims are intended to be embraced therein.

What is claimed is:

1. A musical drum lug for engaging a stop assembly adjustably engaged with a tension link when the other end of the tension link is anchored to a drum head, the stop assembly having generally oppositely facing tightening surfaces separated by a first distance, comprising:

a three dimensional lug body having a top facing a first direction and a side facing a second direction different from said first direction;

a recess formed as a longitudinally extending hollow portion in said lug body for accommodating the stop assembly;

a first opening in said top extending from said recess and having a first width smaller than the first distance;

said recess in said lug body bounded toward said top by a seating surface disposed generally transverse to said first opening;

a second opening in said side extending from said recess and having a second width larger than both said first width and the first distance; said second opening spaced from said seating surface;

said lug body having a plurality of engagement surfaces disposed generally transverse to said seating surface and proximate said second opening; said engagement surfaces further disposed to constrain rotation of said stop assembly by engaging the tightening surfaces when said stop assembly is positioned too shallowly on the tension link for the stop assembly to enter the lug recess, but is disposed at least partially in said second opening.

2. The lug of claim 1 wherein said engagement surfaces are spaced apart by an amount approximately equal to said second width.

3. The lug of claim 1 wherein said lug body further comprises a pair of spaced flanges, said engagement surfaces forming interior surfaces of said flanges.

4. The lug of claim 1 wherein said lug body further comprising at least one threaded mounting hole.

5. The lug of claim 1 wherein said seating surface has a profile of a portion of a sphere.

6. A musical drum lug for engaging a stopper adjustably coupled to a link when an opposing end of the link is anchored to a drum head, the stopper having generally oppositely facing tightening surfaces separated by a first distance, comprising:

a three dimensional lug body having a top and a side;

a recess formed as a longitudinally extending hollow portion in said lug body bounded by a seating surface toward said top for accommodating the stopper and first and second interior sidewalls;

a first opening in said top for allowing the link to pass therethrough, the first opening extending from said recess proximate said seating surface and having a first width smaller than the first distance apart of the oppositely facing tightening surfaces on the stopper;

a second opening in said side extending from said recess and disposed at least partially above said seating surface; said second opening having a second width between said first and second sidewalls larger than both said first width and said first distance; said second opening spaced from said seating surface;

wherein the second opening forms a slot along the side of the lug body that engages the oppositely facing tightening surfaces of the stopper when the stopper is positioned too shallowly on the tension link for the stopper to enter the lug recess, but is disposed at least partially in said the opening.

7. The drum lug of claim 6 wherein said lug body further comprises at least one threaded hole for accepting a fastener for mating the lug body to a drum shell of a musical drum, wherein said lug body further comprises a contoured back surface proximate said threaded hole.

8. The drum lug of claim 6 wherein said seating surface has a profile of a portion of a sphere.

9. A musical drum assembly comprising:

a musical drum shell;

a drum head releasably attached to said drum shell via a plurality of tension link assemblies; each tension link assembly including a tension link and an associated stop assembly adjustably coupled to said tension link; said stop assembly having a faceted portion that includes generally oppositely facing peripheral tightening facets separated by a first distance;

a plurality of side-opening lug bodies fixedly connected to said drum body; each lug body comprising:

a top facing said drum head and a first lateral side;

a recess in bounded by a seating surface toward said top for accommodating the stop assembly;

a first opening in said top extending from said recess for accommodating a tension link of said tension link assemblies and having a first width smaller than the first distance;

a second opening in said first lateral side extending from said recess and having a second width larger than both said first width and the first distance;

a plurality of engagement surfaces proximate said second opening and disposed to constrain rotation of said stop assembly by engaging the tightening facets when said stop assembly is positioned too shallowly on the tension link for the stop assembly to enter the lug recess;

wherein at least one stop assembly of said tension link assemblies abuts a corresponding seating surface to apply tension to said tension link assembly so as to tighten said drum head.

10. The musical drum assembly of claim 9 wherein said stop assembly faceted portion comprises six tightening facets forming a hexagon.

11. The musical drum assembly of claim 9 wherein said recess is formed as a longitudinally extending hollow portion; said seating surface is oriented generally transverse to said first opening; said engagement surfaces are disposed generally transverse to said seating surface.

12. The musical drum assembly of claim 9 wherein said opening extends at least partially above said seating surface.

* * * * *